US007190922B2

(12) United States Patent
Hsu

(10) Patent No.: US 7,190,922 B2
(45) Date of Patent: Mar. 13, 2007

(54) SCAN COPYING APPARATUS WITH A FRAME-CROPPING FUNCTION

(75) Inventor: Seifor Hsu, Chu-Pei (TW)

(73) Assignee: Avision Inc., Hsinchu (TW)

( * ) Notice: Subject to any disclaimer, the term of this patent is extended or adjusted under 35 U.S.C. 154(b) by 206 days.

(21) Appl. No.: 11/003,466

(22) Filed: Dec. 6, 2004

(65) Prior Publication Data

US 2005/0129429 A1 Jun. 16, 2005

(30) Foreign Application Priority Data

Dec. 11, 2003 (TW) ..... 92135054 A

(51) Int. Cl.
*G03G 15/36* (2006.01)

(52) U.S. Cl. ..... 399/182; 358/537

(58) Field of Classification Search ..... 358/157, 358/537; 399/182, 183, 184, 185
See application file for complete search history.

(56) References Cited

U.S. PATENT DOCUMENTS 4,796,052 A * 1/1989 Mizutani et al. ..... 399/183
6,930,799 B2 * 8/2005 Hsu et al. ..... 358/1.9

* cited by examiner

*Primary Examiner*—Walter Benson

(57) ABSTRACT

A scan copying apparatus having a frame-cropping function includes a user interface, a zone-creating unit, an optical scanning module and a processor. In a frame-cropping copy mode, a user inputs, through the user interface, a set of geometric parameters corresponding to a selected scan area of an original. The zone-creating unit, electrically connected to the user interface, receives the set of geometric parameters and creates a cropping frame corresponding to the set of geometric parameters. The optical scanning module scans the selected scan area of the original, according to the cropping frame, to generate a cropping scan signal. The processor, electrically connected to the user interface, the zone-creating unit and the optical scanning module, controls operations of the user interface, the zone-creating unit and the optical scanning module, and processes the cropping scan signal into a cropping print signal.

5 Claims, 3 Drawing Sheets

SCAN COPYING APPARATUS WITH A FRAME-CROPPING FUNCTION

BACKGROUND OF THE INVENTION

1. Field of the Invention

The invention relates to a scan copying apparatus with a frame-cropping function, and more particularly to a scan copying apparatus capable of enabling a user to input parameters to select a specific portion of a original to be scanned and copied.

2. Description of the Related Art

A conventional copier usually provides the function of scaling up or down an original with respect to a reference position located at an origin of a glass window of the copier. So, if the user wants to process (e.g., scale up or down) other regions of the original, he or she has to align the origin of the to-be-processed region of the original with the origin of the glass window, and cannot directly crop the to-be-processed region without moving the original.

Consequently, the user only can obtain the desired result by trial and error. That is, he or she has to attempt the copy process several times, and then manually adjusts the position of the origin with reference to results of each time until a satisfactory result is achieved. Moreover, the obtained result would have a positional error due to the constraints of time and resource. In addition, if the original is a thicker sheet of paper, any movement of the original may create a shadow at an image edge, which would consequently affect the copy quality.

Although the original may be previewed and cropped through the image post-processing, the utilization of the computer, however, would increase the cost and complicate the copying procedure.

Thus, it is an important object of the invention to provide a scan copying apparatus capable of precisely cropping an original as a user desires.

SUMMARY OF THE INVENTION

It is therefore an object of the invention to provide a scan copying apparatus with a frame-cropping function with reference to input parameters.

Another object of the invention is to provide a scan copying apparatus having an index copying function such that a user can determine to-be-inputted parameters corresponding to a specific region for cropping an original according to a measurement of the specific region or the result of the first copy of the original.

To achieve the above-mentioned objects, the invention provides a scan copying apparatus having a frame-cropping copy mode. The scan copying apparatus includes a user interface, a zone-creating unit, an optical scanning module and a processor. In the frame-cropping copy mode, a user inputs, through the user interface, a set of geometric parameters corresponding to a selected scan area of an original. The zone-creating unit, electrically connected to the user interface, receives the set of geometric parameters and creates a cropping frame corresponding to the set of geometric parameters. The optical scanning module scans the selected scan area of the original, according to the cropping frame, to generate a cropping scan signal. The processor, electrically connected to the user interface, the zone-creating unit and the optical scanning module, controls operations of the user interface, the zone-creating unit and the optical scanning module, and processes the cropping scan signal into a cropping print signal.

The scan copying apparatus may also have an index copy mode and may further include a printing device and a second memory for storing a reference grid signal. In the index copy mode, the optical scanning module scans the original to generate an index scan signal, and the processor combines the index scan signal and the reference grid signal into an index print signal. The printing device receives the index print signal and prints an index original, which has a reference grid pattern corresponding to the reference grid signal and an original pattern corresponding to the index scan signal. The reference grid pattern and the original pattern overlap.

Consequently, the user may input the geometric parameters according to the index original obtained in the index copy mode so as to process (scale up, scale down or simply copy) a pattern on a specific region of the original.

Further scope of the applicability of the present invention will become apparent from the detailed description given hereinafter. However,it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
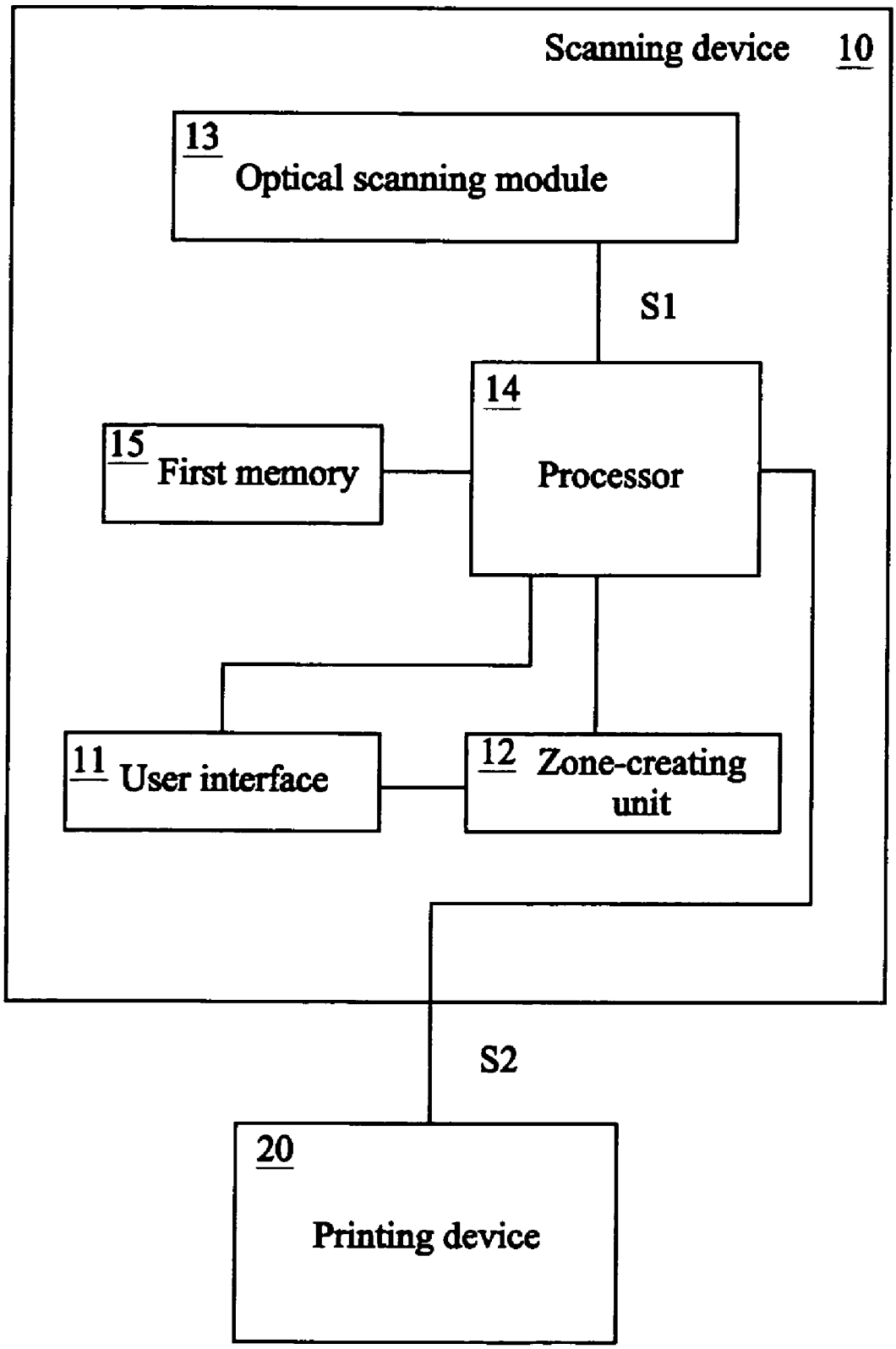
FIG. 1 is a block diagram showing a scan copying apparatus according to a first embodiment of the invention.

FIG. 1 is a block diagram showing a scan copying apparatus according to a first embodiment of the invention. FIG. 3 is a schematic illustration showing a processing procedure of the scan copying apparatus of FIG. 2, wherein a portion of FIG. 3 may also illustrate the operation of the first embodiment. As shown in FIGS. 1 and 3, the scan copying apparatus of this embodiment has a frame cropping copy mode, in which a selected scan area to be scaled up, scaled down or simply copied is defined by the inputted parameters. The scan copying apparatus includes a scanning device 10 and a printing device 20. The scanning device 10 includes a user interface 11, a zone-creating unit 12, an optical scanning module 13, a processor 14 and a first memory 15.

In the frame cropping copy mode, a user inputs plural sets of geometric parameters corresponding to a plurality of selected scan areas 41 to 43 of an original 40 through the user interface 11. However, the number of selected scan areas may also be one. For example, parameters (X1, Y1, X2, Y2) define a rectangular area 43, wherein (X1, Y1) and (X2, Y2) respectively represent the coordinates of two diagonal points P1 and P2 of a rectangle. Alternatively, parameters (X3, Y3, A, B) may define an area 42 of an elliptic shape, wherein (X3, Y3) represent the coordinates of a center O1 of an ellipse, and (A, B) respectively represent a long axis and a short axis of the ellipse. Alternatively, parameters (X4, Y4, R) can define a circular area 41, wherein the parameters (X4, Y4) represent the coordinates of a center O2 of a circle, and R represents the radius of the circle. In addition, other parameters also may be used to define areas of other geometric patterns. Consequently, the user interface 11 may include a numeric keypad, through which the user can input the set of geometric parameters. Usually, the user also can use the numeric keypad to input the number of copies, the telephone number, the e-mail address, or the like.

The zone-creating unit 12 creates cropping frames 41R to 43R corresponding to the geometric parameters. The optical scanning module 13 scans the selected scan areas 41 to 43 of the original 40 according to the cropping frames 41R to 43R so as to generate a cropping scan signal S1. The processor 14 controls operations of the user interface 11, the zone-creating unit 12 and the optical scanning module 13, and processes the cropping scan signal S1 into a cropping print signal S2. If the copy process of the scaling up or down function is to be performed, the processor 14 may be configured to scale up/down the cropping scan signal S1 and to process the scaled cropping scan signal S1 into a cropping print signal S2. The printing device 20 may be an optional member for receiving and printing the cropping print signal S2.

It is to be noted that the cropping print signal S2 of this invention represents the signal that can be directly outputted to an external and regular printer or a built-in printing unit to print the signal.

The first memory 15 is an optional member for storing the set of geometric parameters corresponding to the cropping frames 41R to 43R. Alternatively, the first memory 15 may store plural sets of default geometric parameters. In this case, the user can select, through the user interface 11, one of the plural sets of default geometric parameters as the set of geometric parameters. In the practical operation condition, the user can save several default geometric parameters in the first memory 15 so that the routine copy operations of frame cropping may be easily performed.

The to-be-inputted geometric parameters may be obtained by measuring the associated coordinates and dimensions of the to-be-cropped region with a ruler, and also may be obtained according to the following method.

Figure 2:
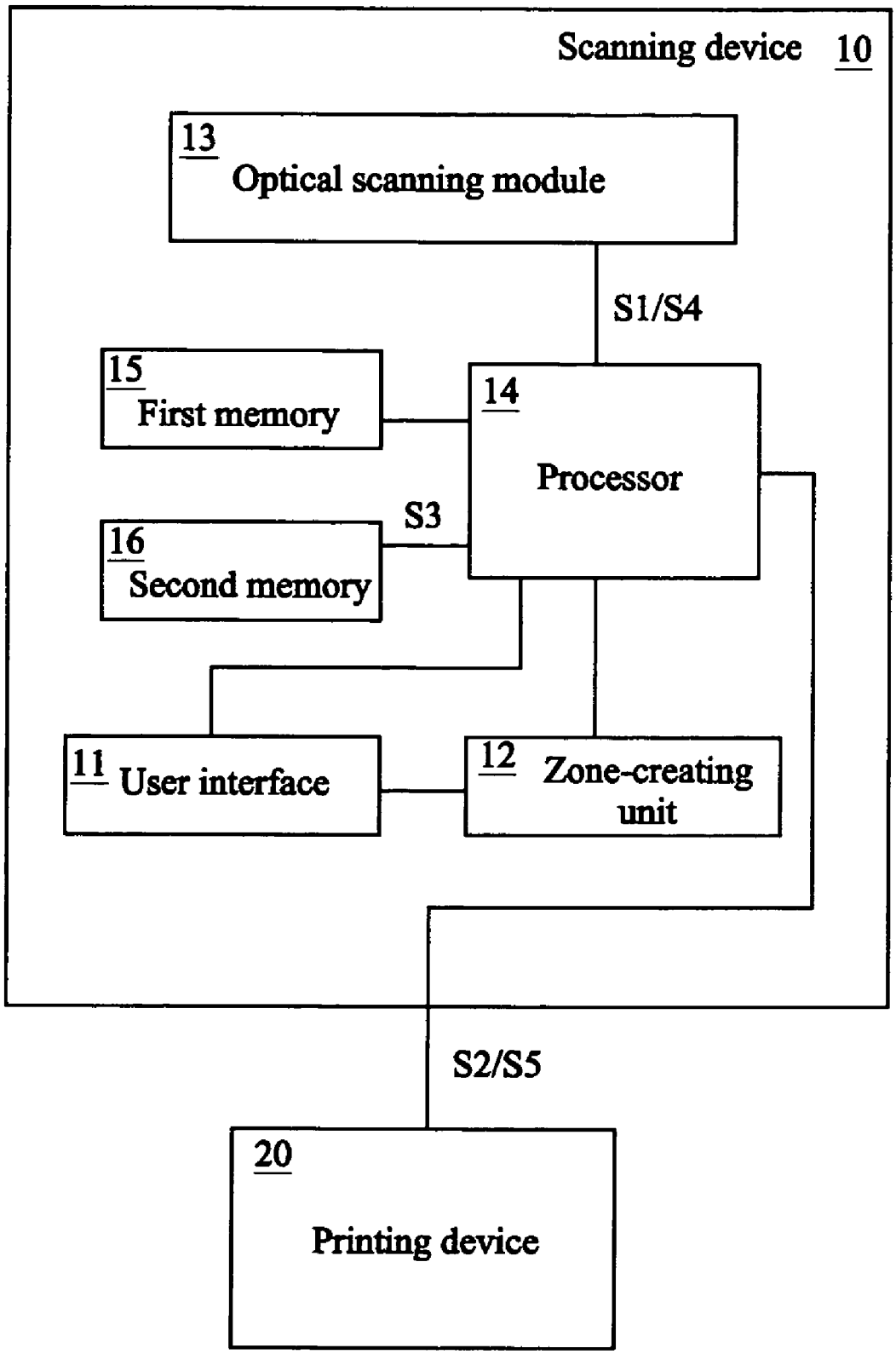
FIG. 2 is a block diagram showing a scan copying apparatus according to a second embodiment of the invention.
Figure 3:
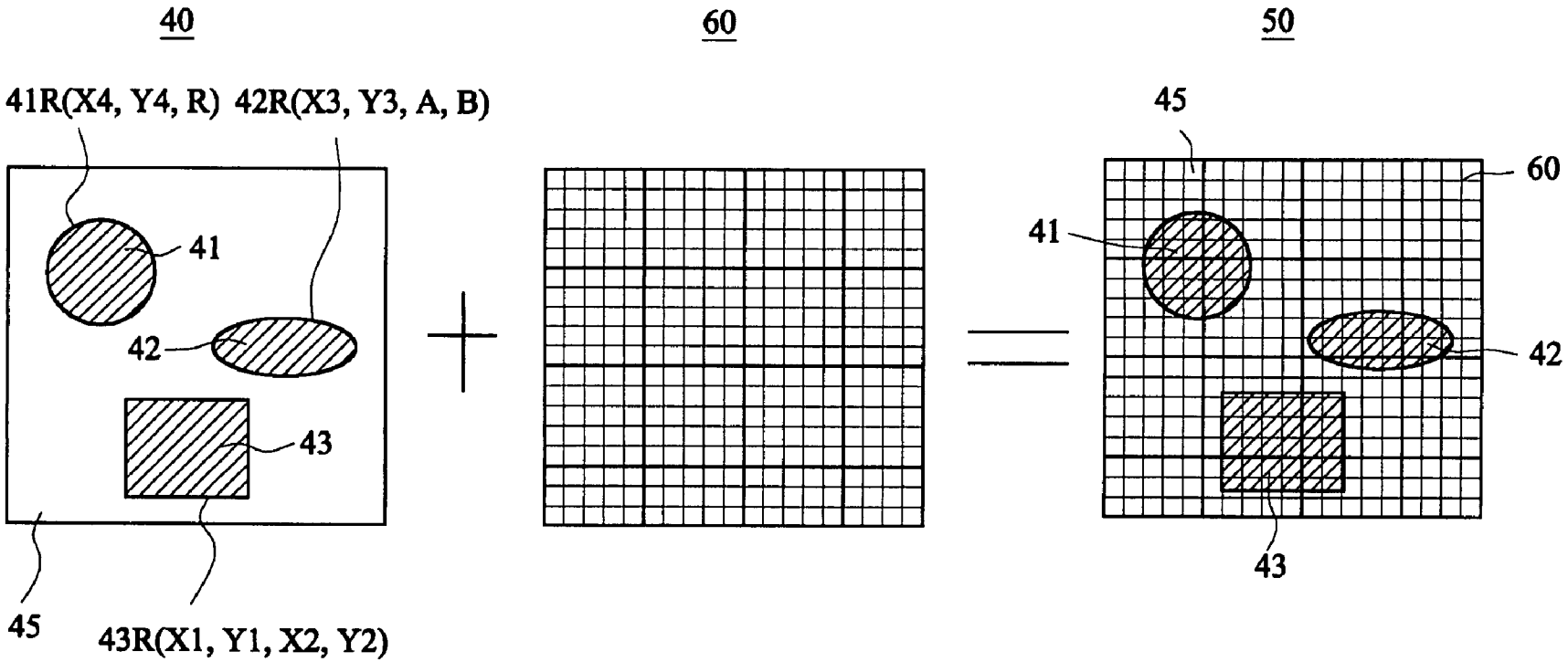
FIG. 3 is a schematic illustration showing a processing procedure of the scan copying apparatus of FIG. 2.

FIG. 2 is a block diagram showing a scan copying apparatus according to a second embodiment of the invention. As shown in FIGS. 2 and 3, the scan copying apparatus of this embodiment has a frame cropping copy mode and an index copy mode. In the frame cropping copy mode, a selected scan region to be scaled up, scaled down or simply copied is defined by inputted parameters. In this index copy mode, a merged printing document filled with grid may be printed such that the user can determine the to-be-cropped scan area of the original.

The scan copying apparatus of this embodiment includes a scanning device 10 and a printing device 20. The scanning device 10 includes a user interface 11, a zone-creating unit 12, an optical scanning module 13, a processor 14, a first memory 15 and a second memory 16.

The second memory 16 has stored a reference grid signal S3 in advance. In the index copy mode, the optical scanning module 13 scans the original 40 to generate an index scan signal S4, and the processor 14 combines the index scan signal S4 and the reference grid signal S3 into a index print signal S5. The printing device 20 receives the index print signal S5 and prints an index original 50. The index original 50 has a reference grid pattern 60 corresponding to the reference grid signal S3 and an original pattern 45 corresponding to the index scan signal S4, and the reference grid pattern 60 and the original pattern 45 overlap. Thus, the user can determine the geometric parameters corresponding to the to-be-cropped selected scan areas 41 to 43 with reference to the reference grid pattern 60.

As a result, when in the frame cropping copy mode, the user inputs the geometric parameters obtained in the index copy mode. The subsequent operations are the same as those of the first embodiment, so detailed descriptions thereof will be omitted.

Without the aid of an external computer, the scan copying apparatus of this invention can frame-crop the region that is not located at the origin of the scan window. The frame-cropping method is achieved with the input of parameters, without increasing much hardware or firmware costs. The user can measure the selected scan area with a ruler, or determine the geometric dimensions and coordinates of the selected scan areas with reference to the index original obtained in the index copy mode. Thus, the position and the dimensions of the selected scan area may be precisely decided according to the result of the first copy of the original, and it is more convenient than the prior art in which the original is manually moved.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A scan copying apparatus with a frame-cropping function having a frame cropping copy mode, the scan copying apparatus comprising:

a user interface, through which a user can input a set of geometric parameters corresponding to a selected scan area of an original;

a zone-creating unit, electrically connected to the user interface, for receiving the set of geometric parameters and for creating a cropping frame corresponding to the set of geometric parameters;

an optical scanning module for scanning the selected scan area of the original according to the cropping frame to generate a cropping scan signal; and a processor, which is electrically connected to the user interface, the zone-creating unit and the optical scanning module, for controlling operations of the user interface, the zone-creating unit and the optical scanning module, and processing the cropping scan signal into a cropping print signal, wherein the scan copying apparatus further has an index copy mode, and the scan copying apparatus further comprises a second memory for storing a reference grid signal, wherein in the index copy mode, the optical scanning module scans the original to generate an index scan signal and the processor combines the index scan signal and the reference grid signal into an index print signal.

2. The apparatus according to claim 1, further comprising:

a printing device for receiving and printing the cropping print signal and the index print signal, wherein the printing device receives the index print signal and prints an index original, the index original has a reference grid pattern corresponding to the reference grid signal and an original pattern corresponding to the index scan signal, and the reference grid pattern and the original pattern overlap.

3. The apparatus according to claim 2, wherein the user interface comprises a numeric keypad, through which the user can input the set of geometric parameters.

4. The apparatus according to claim 2, further comprising:

a first memory for storing the set of geometric parameters.

5. The apparatus according to claim 2, further comprising:

a first memory for storing plural sets of default geometric parameters, wherein the set of geometric parameters is selected, by the user through the user interface, from one of the plural sets of default geometric parameters.

* * * * *